US010716407B1

(12) United States Patent
Bowman

(10) Patent No.: US 10,716,407 B1
(45) Date of Patent: Jul. 21, 2020

(54) BED WARMING DEVICE

(71) Applicant: Mark O. Bowman, Draper, UT (US)

(72) Inventor: Mark O. Bowman, Draper, UT (US)

(73) Assignee: Tark Holdings, LC, Draper, UT (US)

( * ) Notice: Subject to any disclaimer, the term of this patent is extended or adjusted under 35 U.S.C. 154(b) by 131 days.

(21) Appl. No.: 15/948,802

(22) Filed: Apr. 9, 2018

(51) Int. Cl.
*A61F 7/08* (2006.01)
*A47C 21/04* (2006.01)

(52) U.S. Cl.
CPC ..... *A47C 21/048* (2013.01)

(58) Field of Classification Search
CPC ..... A47C 21/04; D04H 1/4291; D04H 3/007; D04H 1/4391; D04H 3/14; D04H 1/425; D04H 1/435; D04H 1/542; D04H 1/645; D04H 3/011; D04H 3/015; D04H 3/16; D04H 1/4242; D04H 1/4334; D04H 1/4382; D04H 1/46; D04H 1/492; D04H 1/50; D04H 1/54; D04H 1/541; D04H 1/58; D04H 3/009; D04H 3/018; D06F 37/04; D06F 37/267; D06F 37/263; D06F 37/206; D06F 37/22; D06F 37/225; D06F 37/268; D06F 37/30; D06F 39/12; D06F 33/02; D06F 37/20; D06F 37/24; D06F 37/264; D06F 37/266; D06F 37/269; D06F 37/304; D06F 37/40; D06F 39/085; D06F 37/00; D06F 37/245; D06F 37/26; D06F 37/262; D06F 39/003; D06F 39/028; D06F 39/04; D06F 39/045; D06F 39/08; D06F 39/083; D06F 39/088; D06F 39/14; D06F 25/00; D06F 2058/2806; D06F 2204/065; D06F 2204/086; D06F 58/24; D06F 58/02; D06F 58/04; D06F 58/20; D06F 58/22; D06F 59/02; D06F 59/04; A61L 15/24;
(Continued)

(56) References Cited

U.S. PATENT DOCUMENTS 4,094,076 A * 6/1978 Baslow ..... A45D 20/12 219/521
4,491,721 A 1/1985 Davis
(Continued)

FOREIGN PATENT DOCUMENTS

CN 106805567 9/2017
GB 501591 A * 2/1939 ..... A47C 21/048

OTHER PUBLICATIONS

Lavroff English translation.*

*Primary Examiner* — Jason Lau
(74) *Attorney, Agent, or Firm* — Sanchelima & Associates, P.A.; Christian Sanchelima; Jesus Sanchelima

(57) ABSTRACT

The present invention is a bed warming device that safely and effectively warms the interior space between the fitted sheet and the top sheet of a bed. The bed warming device includes a heating element similar to those used in hair dryers. The device includes a suction member that suctions ambient air to be heated and delivers it through a narrowing portion that increases the pressure of the heated air. The pressurized, heated air is then expelled to preselected locations of the bed using a plurality of openings located throughout the perimeter of the device's T-shaped hot air delivery assembly. The hot air delivery assembly can include raised portions configured to create a space between the openings and the top bed sheet, thereby maintaining efficient air flow.

10 Claims, 3 Drawing Sheets

(58) Field of Classification Search
CPC ..... A61L 15/20; A61L 15/22; A61L 15/225; A61L 15/26; A61L 15/425; A61L 15/44; A61L 15/60; A61L 2300/606; A61L 2420/02; A61L 2420/06; A61L 9/16; D06P 1/928; D06P 1/228; D06P 1/445; D06P 1/50; D06P 3/6025; D06P 1/0012
See application file for complete search history.

(56) References Cited

U.S. PATENT DOCUMENTS

| | | | | |
|---|---|---|---|---|
| 7,036,575 | B1 * | 5/2006 | Rodney | A47C 21/048 165/138 |
| 2013/0247407 | A1 * | 9/2013 | Richmond | A45D 20/10 34/283 |

* cited by examiner

BED WARMING DEVICE

BACKGROUND OF THE INVENTION

1. Field of the Invention

The present disclosure relates to a device that warms a bed. More particularly, the present disclosure relates to a warming device for a bed removably positioned between the sheets that warms the bed while not burning the user or sheets.

2. Description of the Related Art

During cold weather, beds can quickly drop in temperature and stay significantly colder than a user's body temperature, thereby making it extremely uncomfortable to lie in bed. Hence, there is a need for a bed warming device.

Several designs for warming devices have been designed in the past. None of them, however, include a safe bed warming device that is capable of evenly and selectively distributing warmth between bed sheets.

Applicant believes that a related reference corresponds to Chinese patent application CN106805567 filed by WANG CHUNQIU for an electric heating bed warmer. The Wang reference discloses an electrothermal warmer in which electrically heated water is circulated for heating a bed and thermostats are used for determining and controlling the temperature of the water. However, the bed warmer disclosed by Wang is complex and requires water which can create spills or electrical short circuits.

Another related application is U.S. Pat. No. 4,491,721 filed by Davis Ralph A. for an electric bed heating device. The Davis reference discloses an electric heating element for supplying heat to a bed. However, the Davis reference teaches of an embodiment requiring a plurality of wires that are susceptible to failure and harm to a user.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a bed warming device that is safe to use while delivering heat effectively throughout the interior space defined by bed sheets.

It is yet another object of the present invention to provide a bed warming device that is simple to use and can be selectively positioned at any location in a bed for more tailored heating as desired by a user.

It is still another object of the present invention to provide a bed warming device having a housing having a raised portion at a predetermined location that cooperates with the bed sheet to create separation between the hot air delivery openings and the bed sheet, thereby allowing for efficient air flow in the interior space defined by the bed sheets.

It is another object of the present invention to provide a bed warming device having a plurality of openings throughout its hot air delivery assembly so as to deliver hot air evenly throughout the bed without concentrating hot air in only one section of the bed, thereby enhancing a user's overall comfort and preventing burns to a user or the bed sheets.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
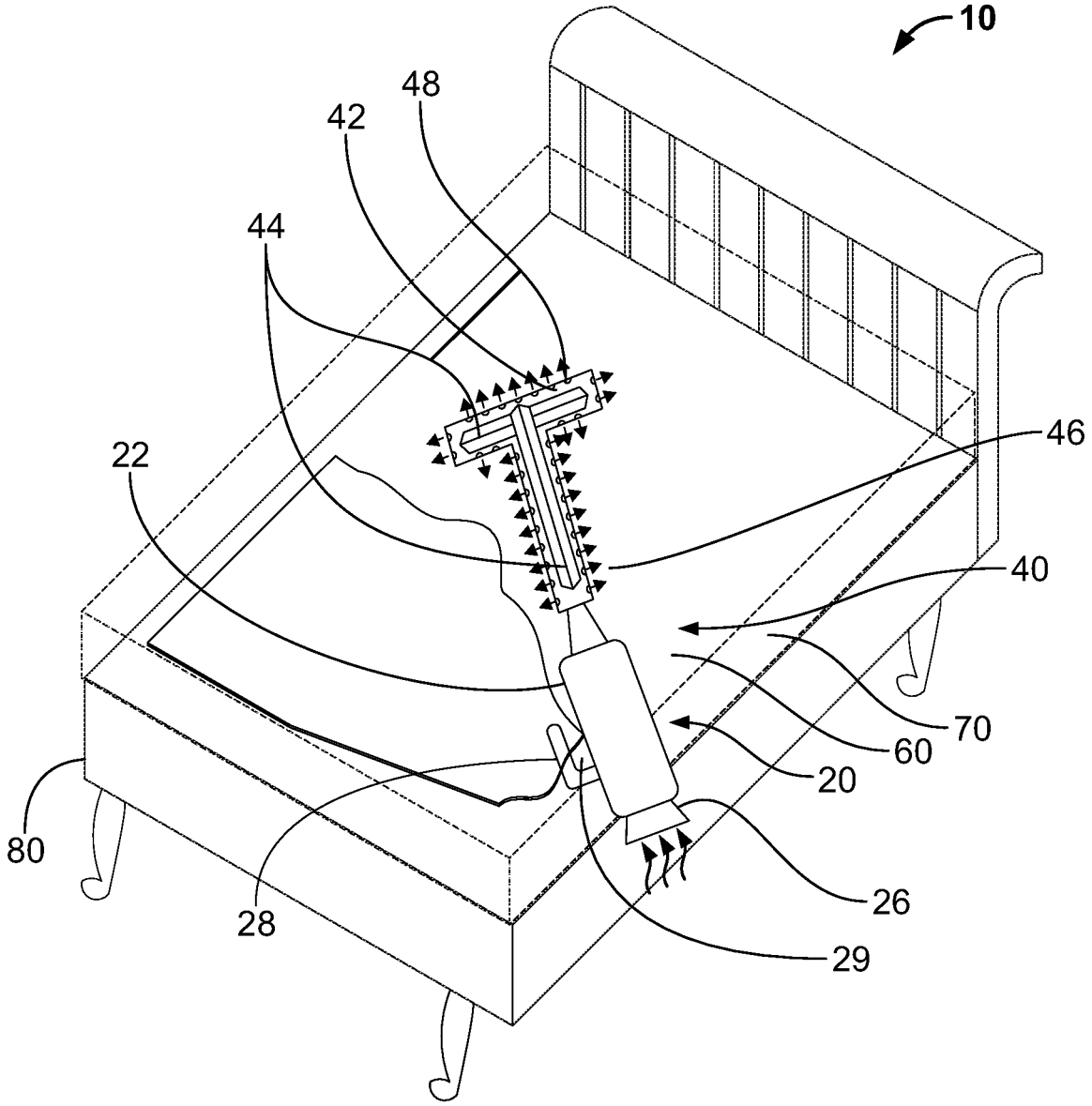
FIG. 1 represents an isometric view of the present invention in its operating environment showing the bed warming device's hot air supply assembly having a handle that includes a slot that receives the distal end of a top bed sheet. The top sheet is shown in a see through to show the configuration of the remainder of the device.
Figure 2:
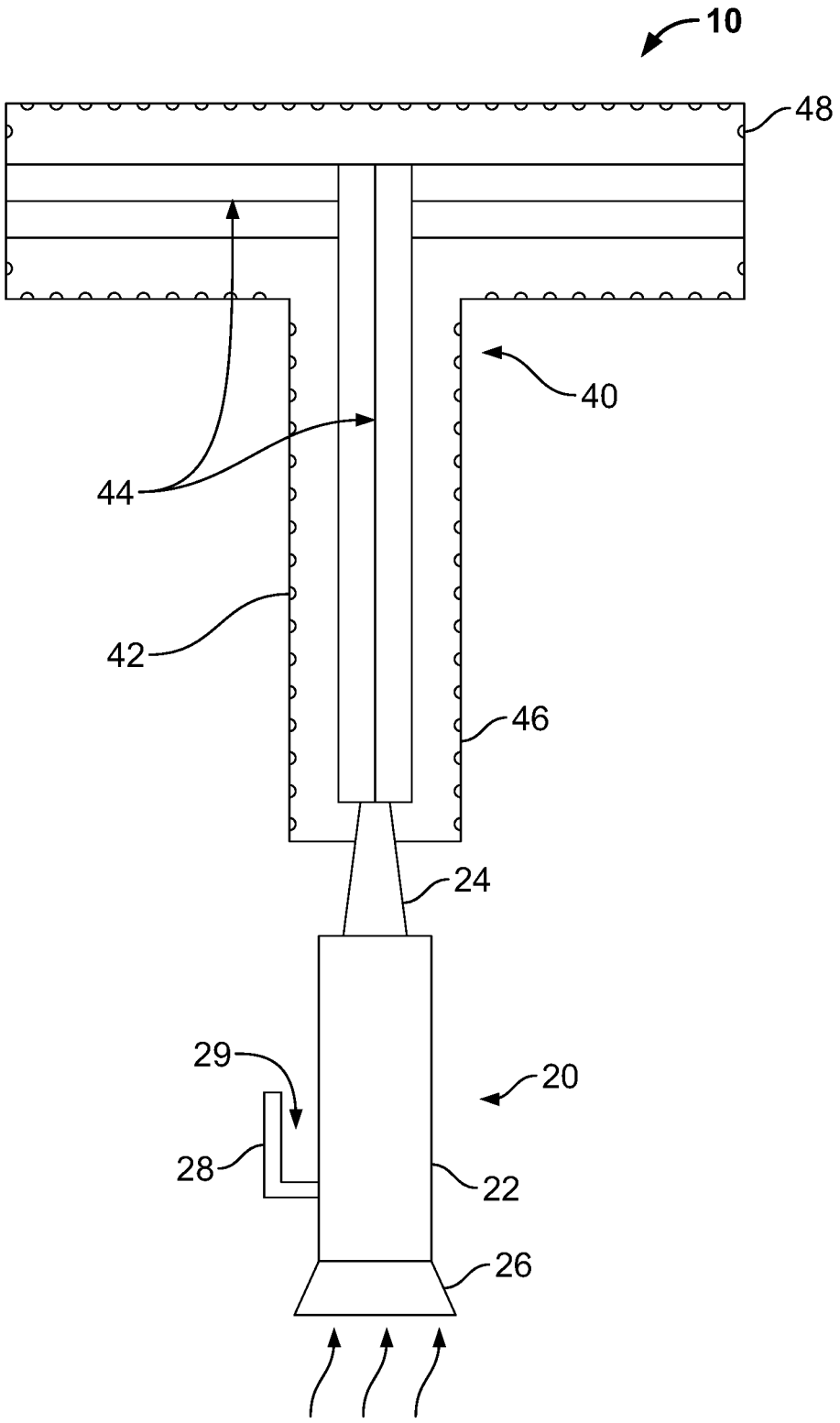
FIG. 2 demonstrates of top view of the bed warming device showing the hot air supply assembly 20 and hot air delivery assembly 40 having a plurality of openings 42 and raised portions 44.
Figure 3:
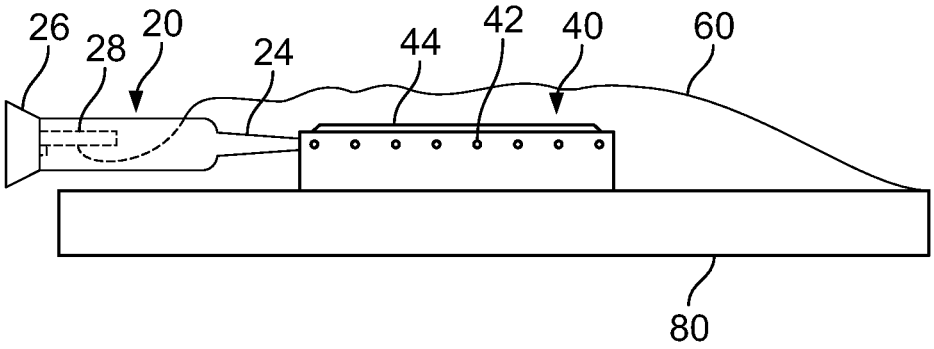
FIG. 3 shows a side elevational view of the bed warming device showing the raised portions 44 adapted to keep top bed sheet 60 away from openings 42, thereby permitting the free flow of hot air without any obstruction by bed sheet 60. Hot air supply assembly 20 is shown having hot air supply member 22 having narrowing portion 24 that increases the pressure that is delivered to openings 42.
Figure 4:
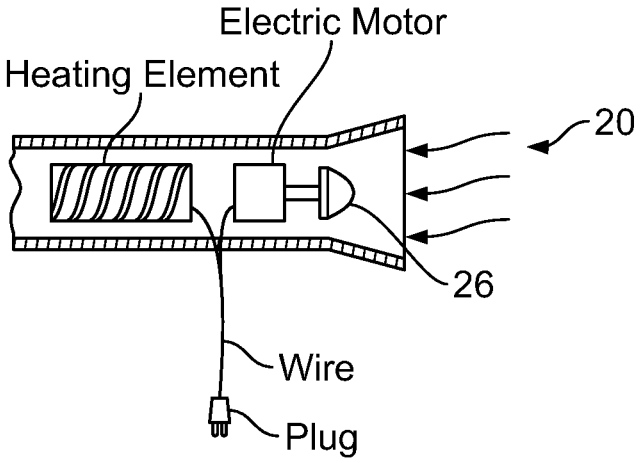
FIG. 4 is a rear elevational view of the present invention wherein suction member 26 is shown that suctions ambient air that is to be heated inside hot air supply assembly 20 using a heating element known in the art such as those found in hair dryers.
Figure 5:
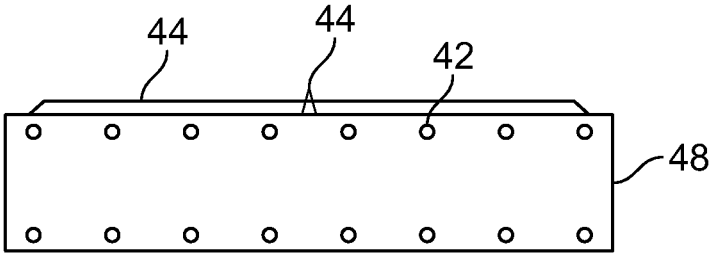
FIG. 5 demonstrates a front view of the present invention wherein openings 42 are shown at the front distal end of the present invention.

Referring now to the drawings, FIGS. 1-5, where the present invention is generally referred to with numeral 10, it can be observed that a bed warming device, in accordance with one embodiment, is provided that includes hot air supply assembly 20, hot air delivery assembly 40, bed sheet 60, and bed 80.

Hot air supply assembly 20 includes hot air supply member 22, narrowing portion 24, suction member 26, handle 28, and bed sheet receiving slot 29. Hot air supply member 22 includes within it a heating element similar to those found within a hair dryer. Similar to the heating elements found in hair dryers the heating element of the present invention can include coiled nichrome wire that's wrapped around insulating mica boards. The heating element can be powered by alternating current in a preferred embodiment, but direct current can also be used. Narrowing portion 24 is located between the main housing of hot air supply assembly and hot air delivery assembly 40 and is configured to reduce the space the hot air travels through by a predetermined amount, thereby increasing the pressure of the hot air that is transferred to delivered to hot air delivery assembly 40.

Hot air supply assembly 20 also includes suction member 26 that is located at the rear distal end of the present invention and is adapted to suction ambient air to be heated by the heating element housed within hot air supply member 22. In an alternate embodiment, suction member 26 can be located on the side or top of hot air supply member 22. The top side of hot air supply member 22 can include a handle 28 that is separated from the top of the hot air supply member housing by a preselected distance to define a bed sheet receiving slot 29 that is adapted to receive bed sheets 60 so that the hot air is efficiently delivered within the bed sheets and so that the bed sheets do not cover suction member 26. In one embodiment, handle 28 or slot 29 can include engagement means to secure the distal end of bed sheet 60, such as a clip.

Hot air supply assembly 20 can be integrally or removably mounted to hot air delivery assembly 40. In one embodiment, hot air delivery assembly 40 can have a T-shaped configuration to maximize the area of the bed covered by hot air. Hot air delivery assembly 40 includes openings 42 adapted to deliver hot air throughout the bed in the area between the fitted sheet 70 and the top sheet 60 of bed 80. Hot air delivery assembly 40 also includes raised portions 44 and first delivery member 46 and second delivery member 48. First delivery member 46 and second delivery member 48 can be mounted to each other perpendicularly and can be integrally or removably mounted to each other. Raised portions 44 can be integrally included at the top side of the first delivery member 46 can configured to maintain a spacing between top bed sheet 60 and openings 46 to maintain efficient air flow. Similarly, second delivery member 48 can include raised portions 44 integrally located at its top side to keep top bed sheet 60 sufficiently spaced from openings 46, thereby maintaining air flow.

The present invention can be positioned at any location on the bed desired by a user. Hot air supply assembly 20 can be located at the head or foot of the bed depending on what is most convenient for a user and the power supply configuration of the bedroom. The heating element in one embodiment can heat the air to about 103 degrees to 108 degrees Fahrenheit although other effective temperatures can also be used. The present invention can include a power button to actuate the device, power indicator lights, a thermostat measuring the temperature of the heated air, and a graduated knob that allows a user to modulate the pressure of the heated air or its temperature.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bed warming device, comprising:

a. a hot air supply assembly having a hot air supply housing having a top end and a top side wall and a bottom sidewall, a handle mounted to said top end, a slot defined by the spacing between said handle and said top end that is configured to receive a bed sheet's distal ends, said hot air supply assembly includes a narrowing portion adapted to increase the pressure of the heated air passing therethrough, said hot air supply assembly further includes a heating element housed therein, said narrowing portion tapers inwardly away from said heating element, a suction member located on said bottom sidewall adapted to receive ambient air to be heated, said narrowing portion having a substantially conical shape; and b. a hot air delivery assembly having a vertical member and a horizontal member defining a T-shaped directing tube, said vertical member is longer than said horizontal member and each includes a plurality of openings adapted to allow hot air through, said horizontal member includes a first and second lateral distal end that each includes at two openings, said openings being smaller than the length of said first and second distal end, said vertical member includes a bottom distalmost end that includes a bottom opening, said bottom opening receives said narrowing portion to mount said hot air delivery assembly to said hot air supply assembly, wherein said narrowing portion is located between said heating element and said directing tube.

2. The bed warming device of claim 1 wherein said heating element is coiled nichrome wire wrapped around insulating mica boards.

3. The bed warming device of claim 1 powered by alternating or direct current.

4. The bed warming device of claim 1 wherein said suction member is mounted to said hot air supply assembly's top end or said side wall.

5. The bed warming device of claim 1 wherein said hot air supply assembly and said hot air delivery assembly are integrally or removably mounted to each other.

6. The bed warming device of claim 1 made of plastic.

7. The bed warming device of claim 1 wherein said heating element is configured to heat air suctioned by said suction member to a range of 103 to 108 degrees Fahrenheit.

8. The bed warming device of claim 1 wherein said first and second delivery members are removably coupled to each other.

9. The bed warming device of claim 1 wherein said directing tube includes a cross shaped raised portion located on a top end of said directing tube.

10. A system for a warming device, comprising:

a. a bed frame having a headboard;

b. a mattress having a fitted sheet;

c. a bed sheet;

d. a hot air supply assembly having a hot air supply housing having a top end and a top side wall and a bottom sidewall, a handle mounted to said top end, a slot defined by the spacing between said handle and said top end that is configured to receive said bed sheet's distal ends, said hot air supply assembly includes a narrowing portion adapted to increase the pressure of the heated air passing therethrough, said hot air supply assembly further includes a heating element housed therein, wherein said narrowing portion is located on said top side wall after said heating element and tapers inwardly form said top side wall, a suction member located on said bottom sidewall adapted to receive ambient air to be heated; and e. a hot air delivery assembly having a T-shaped directing tube, said T-shaped directing tube having a first delivery member and a second delivery member each having a plurality of openings that are adapted to allow hot air to be released through an interior space defined by a space between a top end of said bed sheet and said fitted sheet, wherein said plurality of openings are perforations, wherein said first delivery member is a vertical cubic-rectangular housing, wherein said plurality of openings are located along a left side and a right side of said first delivery member, wherein said second delivery member is a horizontal cubic-rectangular housing, said plurality of openings located along an entire perimeter of said second delivery member, wherein said second delivery member includes a front end having two sets of said plurality of openings, wherein said two sets of said plurality of openings are parallel to each other, wherein said narrowing portion of said hot air supply assembly extends within said first delivery member a predetermined amount, wherein said first delivery member is perpendicularly coupled to said second delivery member to form said T-shaped directing tube, said first and second delivery members each having a top side, a cross shaped raised portion located on said first and second delivery member top side adapted to maintain an effective spacing between said openings and said top bed sheet.

* * * * *